US009399360B2

(12) United States Patent
Gassho

(10) Patent No.: US 9,399,360 B2
(45) Date of Patent: Jul. 26, 2016

(54) PRINTING DEVICE

(71) Applicant: SEIKO EPSON CORPORATION, Tokyo (JP)

(72) Inventor: Kazuhito Gassho, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/612,689

(22) Filed: Feb. 3, 2015

(65) Prior Publication Data

US 2015/0273894 A1 Oct. 1, 2015

(30) Foreign Application Priority Data

Mar. 31, 2014 (JP) ..... 2014-073422

(51) Int. Cl.
*B41J 29/46* (2006.01)
*B41J 13/10* (2006.01)
*B41J 11/00* (2006.01)

(52) U.S. Cl.
CPC ..... *B41J 29/46* (2013.01); *B41J 13/103* (2013.01); *B41J 11/0075* (2013.01)

(58) Field of Classification Search
CPC ..... B41J 11/009; B41J 29/393; B41J 13/103; B41J 11/485; B41J 5/044; B41J 2/1752; B65H 1/266; B65H 2220/11; B65H 2405/31; B65H 2405/32
USPC ..... 347/16, 14, 19, 20, 101, 104, 105
See application file for complete search history.

(56) References Cited

U.S. PATENT DOCUMENTS

| | | | | |
|---|---|---|---|---|
| 6,527,356 | B1 * | 3/2003 | Spurr et al. | 347/16 |
| 8,360,541 | B2 * | 1/2013 | Kazmaier | B41J 11/009 347/9 |
| 2005/0073085 | A1 * | 4/2005 | Fukada et al. | 271/9.09 |
| 2008/0084020 | A1 * | 4/2008 | Nakamura | 270/1.01 |
| 2013/0134658 | A1 | 5/2013 | Nagai | |

FOREIGN PATENT DOCUMENTS

JP 2013-112449 A 6/2013

* cited by examiner

*Primary Examiner* — Thinh Nguyen
(74) *Attorney, Agent, or Firm* — Global IP Counselors, LLP

(57) ABSTRACT

A printing device includes a housing unit configured to be withdrawn from a device main unit and mounted in the device main unit, a specification operating unit provided on the housing unit and operated so as to specify a type of a medium, and a control device configured to implement control according to the type of the medium specified by the specification operating unit. The control device implements a warning process when the type of the medium specified by the specification operating unit when the housing unit is withdrawn from the device main unit is the same as the type of the medium specified by the specification operating unit when the housing unit is mounted in the device main unit after that.

9 Claims, 7 Drawing Sheets

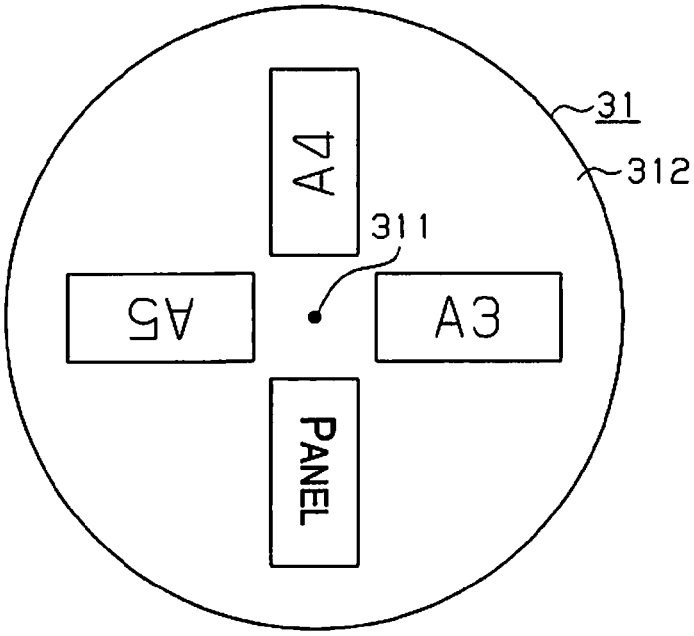
Fig. 2
Fig. 3A
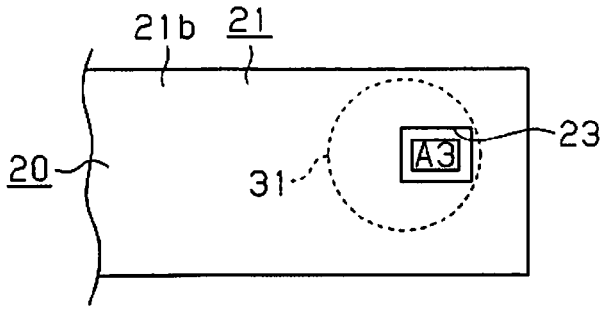
Fig. 3B
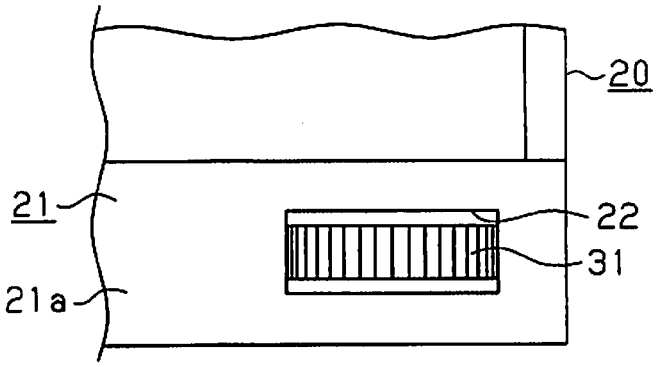

PRINTING DEVICE

CROSS-REFERENCE TO RELATED APPLICATIONS

This application claims priority to Japanese Patent Application No. 2014-073422 filed on Mar. 31, 2014. The entire disclosure of Japanese Patent Application No. 2014-073422 is hereby incorporated herein by reference.

BACKGROUND

1. Technical Field

The present invention relates to a printing device.

2. Related Art

Noted in Unexamined Patent Publication No. 2013-112449 is an example of a printing device equipped with a paper feed cassette (example of a housing unit) that can be withdrawn from a device main unit and mounted in the device main unit. Provided on the paper feed cassette of this kind of printing device is a dial (example of a specification operating unit) rotated by operation by a user. This dial is operated by the user so as to specify the size of the paper (example of the type of media) housed inside the paper feed cassette, and a signal according to the paper size specified using the dial is output to a control device of the printing device. Then, when performing recording on the paper inside that paper feed cassette, the control device implements various types of processing such as paper conveying processing and the like according to the paper size specified using the dial.

However, with the kind of printing device noted above, there are cases when the user forgets to operate the dial for the paper feed cassette in which paper is loaded. In particular, when the size of the paper loaded in the paper feed cassette the previous time (e.g. A3) and the size of the paper loaded in the paper feed cassette this time (e.g. A4) are different, the size of the paper actually housed inside the paper feed cassette and the size of the paper specified using the dial will be different. In this case, there is the risk that it will not be possible to suitably implement processing using the paper size specified using the dial as a parameter, and that an error such as a paper jam or the like will occur, for example.

SUMMARY

An object of the present invention is to provide a printing device that can inhibit forgetting of specifying the type of media housed inside the housing unit.

The printing device for achieving the object noted above comprises a device main unit, inside of which printing is implemented on a medium, a housing unit which is configured to be withdrawn from the device main unit and mounted in the device main unit, and in which the medium is housed, a first specification operating unit provided on the housing unit, operated in order to specify a type of the medium, and a control device configured to implement control according to the type of the medium specified with the first specification operating unit. With this printing device, the control device is further configured to implement the warning process when the type of the medium specified by the first specification operating unit when the housing unit is withdrawn from the device main unit is the same as the type of the medium specified by the first specification operating unit when the housing unit is mounted in the device main unit after the housing unit is withdrawn from the device main unit.

When the type of the medium specified by the first specification operating unit when the housing unit is withdrawn from the device main unit is the same as the type of the medium specified by the first specification operating unit when the housing unit is mounted in the device main unit after that, when the medium is loaded in that housing unit, there is a possibility that the user will forget to operate the first specification operating unit. Because of that, with the constitution noted above, in this case, by implementing the warning process, it is possible to prompt the user to operate the first specification operating unit. Therefore, it is possible to inhibit forgetting of specifying the type of the medium housed inside the housing unit.

The control device is further configured not to implement a warning process when the type of the medium specified by the first specification operating unit when the housing unit is withdrawn from the device main unit is different from the type of the medium specified by the first specification operating unit when the housing unit is mounted in the device main unit after the housing unit is withdrawn from the device main unit.

When the type of the medium specified by the first specification operating unit when the housing unit is withdrawn from the device main unit is different from the type of the medium specified by the first specification operating unit when the housing unit is mounted in the device main unit after that, it is possible to judge that the user operated the first specification operating unit. Because of that, in this case, the warning process is not implemented. Specifically, despite the user suitably operating the first specification operating unit, it is possible to reduce the opportunities for inadvertent implementing of the warning process to occur.

With the printing device noted above, the warning process is preferably a process that prompts operation of the first specification operating unit. With this constitution, it is possible to suitably prompt the user to operate the first specification operating unit by implementing the warning process.

With printing device noted above, the device main unit includes a second specification operating unit operated in order to specify the type of the medium housed inside the housing unit, separate from the first specification operating unit. The first specification operating unit is constituted so as to select a first mode for specifying the control device for control according to the type of the medium specified by the first specification operating unit, and a second mode for specifying the control device for control in charge of an operation of the second specification operating unit for specifying the type of the medium inside the housing unit. In this case, it is preferable that the control device is further configured to allow implementation of the warning process when the first specification operating unit is in the first mode. The control device is further configured to implement a report process that prompts specification of the type of the medium with the second specification operating unit without implementing the warning process when the first specification operating unit is in the second mode.

With the constitution noted above, when the first specification operating unit is in the second mode, when the housing unit is mounted in the device main unit, by implementing the report process, it is possible to prompt the user to operate the second specification operating unit. Because of that, it is possible to inhibit the user from forgetting to operate the second specification operating unit.

Also, when the first specification operating unit is in the first mode, when the type of the medium specified by the first specification operating unit when the housing unit is withdrawn from the device main unit is the same as the type of the medium specified by the first specification operating unit when the housing unit is mounted in the device main unit after that, the warning process is implemented. By doing this, it is possible to suitably prompt the user to operate the first specification operating unit.

On the other hand, even when the first specification operating unit is in the first mode, when the type of the medium specified by the first specification operating unit when the housing unit is withdrawn from the device main unit is different from the type of the medium specified by the first specification operating unit when the housing unit is mounted in the device main unit after that, both the warning process and the report process are not implemented. Thus, it is possible to inhibit prompting of the user to operate the first specification operating unit or the second specification operating unit to specify the type of the medium despite the type of the medium inside the housing unit having been suitably specified by the user operating the first specification operating unit.

The printing device noted above can also include a mounting detection sensor configured to detect withdrawal of the housing unit from the device main unit and mounting of the housing unit into the device main unit. In this case, it is preferable that the control device is further configured not to implement the warning process when the type of the medium specified by the first specification operating unit when it is detected by the mounting detection sensor that the housing unit has been withdrawn from the device main unit is different from the type of the medium specified by the first specification operating unit when it is detected by the mounting detection sensor that the same housing unit has been mounted in the device main unit after it has been detected by the mounting detection sensor that the housing unit has been withdrawn from the device main unit. The control device is further configured to implement the warning process when it is detected by the mounting detection sensor that the housing unit has been mounted in the device main unit in a case when the type of the medium specified by the specification operating unit when it is detected by the mounting detections sensor that the housing unit has been withdrawn from the device main unit is the same as the type of the medium specified by the first specification operating unit when it is detected by the mounting detection sensor that the housing unit has been mounted in the device main unit after it has been detected by the mounting detection sensor that the housing unit has been withdrawn from the device main unit.

With the constitution noted above, it is possible for withdrawal of the housing unit from the device main unit and mounting of the housing unit in the device main unit to be detected by the mounting detection sensor.

The printing device noted above can also include a media presence or absence sensor configured to detect a presence or absence of the medium inside the housing unit. In this case, it is preferable that when the media presence or absence sensor detects a shift from a state of there not being the medium inside the housing unit to a state of there being the medium inside the housing unit, the control device is further configured to determine that the housing unit is mounted in the device main unit. With this constitution, it is possible to judge whether or not the housing unit is mounted in the device main unit based on the detection results by the media presence or absence sensor.

The printing device noted above can also include a media presence or absence sensor configured to detect a presence or absence of the medium inside the housing unit. In this case, it is preferable that, in a state for which it is detected by the media presence or absence sensor that there is the medium inside the housing unit, when it is detected by the mounting detection sensor that the housing unit has been withdrawn from the device main unit, the control device is further configured to allow implementation of the warning process when it is detected by the media presence or absence sensor that there is the medium inside the housing unit when, after it has been detected by the mounting detection sensor that the housing unit has been withdrawn from the device main unit, it has been detected by the mounting detection sensor that the housing unit is mounted in the device main unit.

There are cases when in a state with the medium still inside the housing unit, that same housing unit is withdrawn from the device main unit, and after that, that same housing unit is mounted in the device main unit. In this case, with the constitution noted above, in a state with the housing unit withdrawn from the device main unit, there is a possibility of the type of the medium housed in that same housing unit being changed, so warning process is implemented. Therefore, it is possible to prompt the user to specify the type of the medium.

With the printing device noted above, it is preferable that, in a state for which it is detected by the media presence or absence sensor that there is no the medium inside the housing unit, when it is detected by the mounting detection sensor that that housing unit has been withdrawn from the device main unit, the control device prohibits implementation of the warning process when it is detected by the media presence or absence sensor that there is the medium inside the housing unit when, after it has been detected by the mounting detection sensor that the housing unit has been withdrawn from the device main unit, it is detected by the mounting detection sensor that the housing unit has been mounted in the device main unit.

In a state with no medium inside the housing unit, there are cases when that same housing unit is withdrawn from the device main unit, and after that, that same housing unit is mounted in the device main unit. In this case, with the constitution noted above, there is a possibility of the same type of the medium as the medium loaded previously being loaded in the housing unit, so the warning process is not implemented. Because of that, it is possible to inhibit inadvertent implementation of the warning process when specification of the medium type is not necessary.

With the printing device noted above, it is preferable that the type of the medium specified by the first specification operating unit includes the medium size. With this constitution, by operating the first specification operating unit, it is possible to specify the size of the medium housed inside the housing unit.

BRIEF DESCRIPTION OF THE DRAWINGS

Referring now to the attached drawings which form a part of this original disclosure:

FIG. 2 is a plan view schematically showing the operating dial;

FIGS. 3A and B are drawings showing the state with the operating dial attached to the paper feed cassette;

DETAILED DESCRIPTION OF EXEMPLARY EMBODIMENTS

Following, we will describe an embodiment of a printing device according to FIG. 1 through FIG. 8.

Figure 1:
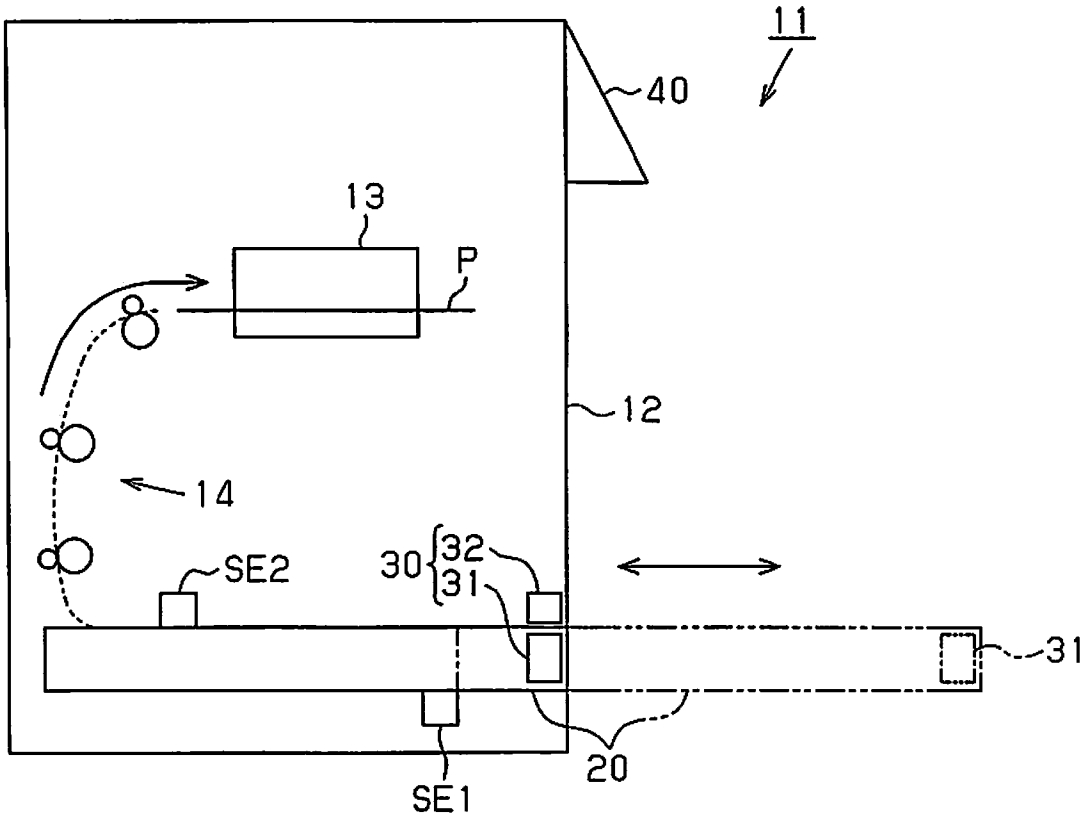
FIG. 1 is a schematic diagram showing an embodiment of the printing device.

As shown in FIG. 1, inside a device main unit 12 of a printing device 11, provided are a printing unit 13 for implementing printing on paper P which is an example of a medium (media), a conveyance unit 14 for conveying to the printing unit 13 the paper P inside a paper feed cassette 20 which is an example of a housing unit, and a display operating panel 40 which is a user interface. As the printing method by the printing unit 13, examples include the inkjet method, laser method, and dot impact method.

A plurality of sheets of the paper P are housed in a layered state inside the paper feed cassette 20. This kind of paper feed cassette 20 can be withdrawn from the device main unit 12 and can be mounted in the device main unit 12. Specifically, the state shown by the solid line in FIG. 1 is a state for which it is possible to convey the paper P inside the paper feed cassette 20 to the printing unit 13 by operation of the conveyance unit 14, and a state for which the paper feed cassette 20 is mounted in the device main unit 12. On the other hand, the state shown by the double-dot-dash line in FIG. 1 is a state for which it is not possible to supply the paper P inside the paper feed cassette 20 to the printing unit 13 because it is pulled out from the device main unit 12, and is a state for which the paper feed cassette 20 is withdrawn from the device main unit 12. Thus, with this specification, the state of the paper feed cassette 20 shown by the solid line in FIG. 1 is also called the "mounted state," and the state of the paper feed cassette 20 shown by the double-dot-dash line in FIG. 1 is also called the "withdrawn state."

Provided on this kind of device main unit 12 are a mounting detection sensor SE1 for detecting whether the paper feed cassette 20 is in a mounted state or a withdrawn state, and a paper presence or absence sensor SE2 which is an example of the media presence or absence sensor that detects whether or not there is paper P inside the paper feed cassette 20 that is in the mounted state. The signal output mode from the paper presence or absence sensor SE2 when there is no paper P inside the paper feed cassette 20 and the signal output mode from the paper presence or absence sensor SE2 when the paper feed cassette 20 is in a withdrawn state are about equivalent.

On the printing device 11 of this embodiment is provided a type detection system 30 for detecting the size (an example of a type) of the paper P housed inside the paper feed cassette 20. Specifically, the type detection system 30 has an operating dial 31 which is an example of a first specification operating unit operated by the user provided on the paper feed cassette 20, and a specified type detection switch 32 provided on the device main unit 12. This specified type detection switch 32 detects the state of the operating dial 31 when the paper feed cassette 20 is in a mounted state, and outputs a signal according to the detection results to the control device. Specifically, the specified type detection switch 32 specifies to the control device control according to the state of the operating dial 31.

As shown in FIG. 2, the operating dial 31 has a round disk shape, and the paper feed cassette 20 is provided in a state so as to be able to rotate with a rotation axis 311 provided at its center as the center. Then, for example, noted on one surface 312 of the operating dial 31 are notations indicating the plurality of paper sizes (in this case, A3, A4, and A5), and a notation indicating the display operating panel 40 (in this case, Panel). Each of these notations is arranged with an equal gap in the circumferential direction.

As shown in FIGS. 3A and B, the operating dial 31 is provided inside a front side wall 21 which is the side wall at the front side of the paper feed cassette 20. Specifically, a housing chamber in which the operating dial 31 is arranged in a state to be able to rotate is provided inside the front side wall 21, and an opening 22 for communication by that housing chamber with the exterior is provided on a top surface 21*a* of the front side wall 21. By doing this, when the paper feed cassette 20 is in a withdrawn state, the operating dial 31 inside the housing chamber noted above can be rotated by operation by the user.

Also, a communication window 23 that connects the interior of the housing chamber noted above with the exterior if provide on a front surface 21*b* of the front side wall 21. By doing this, with any one of the notations noted on the one surface 312 of the operating dial 31 (in FIG. 3A, A3), it is possible to see this from the outside via the communication window 23.

Specifically, when the user loads the paper P inside the paper feed cassette 20 in a withdrawn state, the operating dial 31 is rotated so it is possible to see from outside via the communication window 23 the notation expressing the size of the paper P loaded in the paper feed cassette 20. However, as shown in FIG. 2, the number of paper sizes that can be noted on the operating dial 31 is limited. Because of that, when paper P of a size not noted on the operating dial 31 (e.g. B5) is loaded in the paper feed cassette 20, the user rotates the operating dial 31 to be able to see from the outside via the communication window 23 the notation indicating the display operating panel 40 (in this case, Panel). In this case, after the paper feed cassette 20 is put in a mounted state, by the user operating the display operating panel 40, he specifies the size of the paper P in the paper feed cassette 20. In light of this point, the display operating panel 40 correlates to an example of the "second specification operating unit."

With this embodiment, the mode of the operating dial 31 by which the notation indicating the paper size (in this case, A3, A4, and A5) can be seen via the communication window 23 from the outside correlates to an example of the "first mode." The mode of the operating dial 31 by which the notation indicating the display operating panel 40 (in this case, Panel) can be seen via the communication window 23 from the outside correlates to an example of the "second mode." Then, when the paper feed cassette is in a mounted state, when the operating dial 31 is in the second mode, a signal to that effect is output from the specified type detection switch 32. Specifically, when the operating dial 31 is in the second mode, the specified type detection switch 32 specifies to the control device control in charge of operation using the display operating panel 40 to specify the paper size. Also, when the operating dial 31 is in the first mode, signals according to the paper size specified by the operating dial 31 are output from the specified type detection switch 32. Specifically, when the operating dial 31 is in the first mode, the specified type detection switch 32 specifies to the control device control according to the paper size specified using the operating dial 31.

Next, we will describe the operating panel 40 while referring to FIG. 4.

Figure 4A:
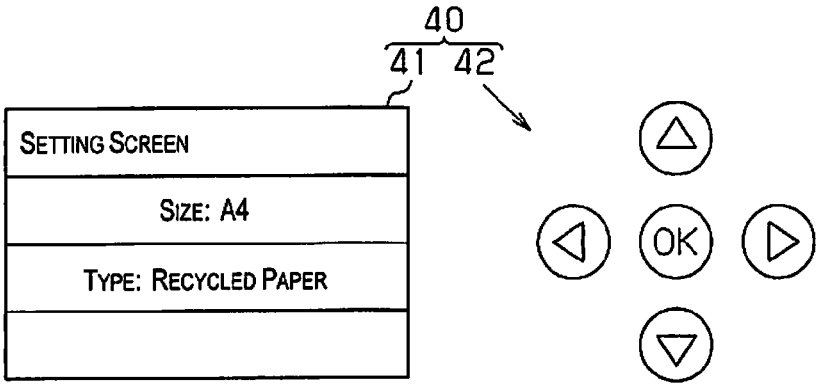
FIGS. 4A through 4C are schematic diagrams showing the display operating panel.

As shown in FIG. 4A, the display operating panel 40 has a display screen 41 and a button operating unit 42. Then, when the operating dial 31 provided on the paper feed cassette 20 is in the second mode, when "Size" is selected with the display screen 41 shown in FIG. 4A, the display mode of the display screen 41 transitions from the display mode shown in FIG. 4A to the display mode shown in FIG. 4 B. Specifically, the display mode shown in FIG. 4 B is a mode for specifying the size of the paper P housed inside the paper feed cassette 20. Then, in this mode, by operating the button operating unit 42 of the display operating panel 40, it is possible to specify the size of the paper P housed inside the paper feed cassette 20.

On the other hand, when the operating dial 31 is in the first mode, transition from the display mode shown in FIG. 4A to the display mode shown in FIG. 4 B is prohibited. Specifically, the specification of the paper size with the display operating panel 40 is prohibited.

Figure 4B:
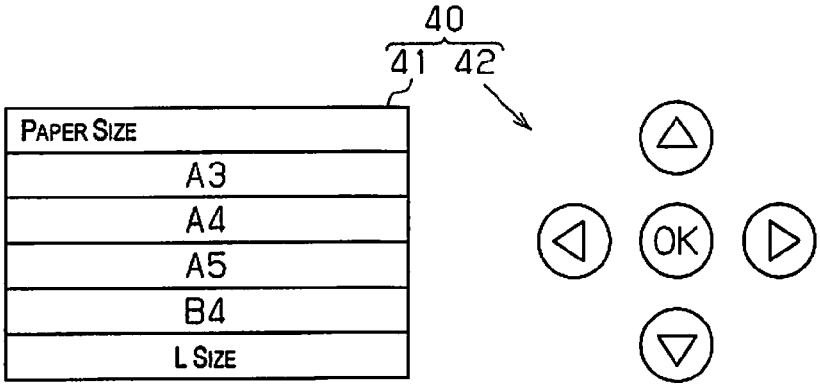
Figure 4C:
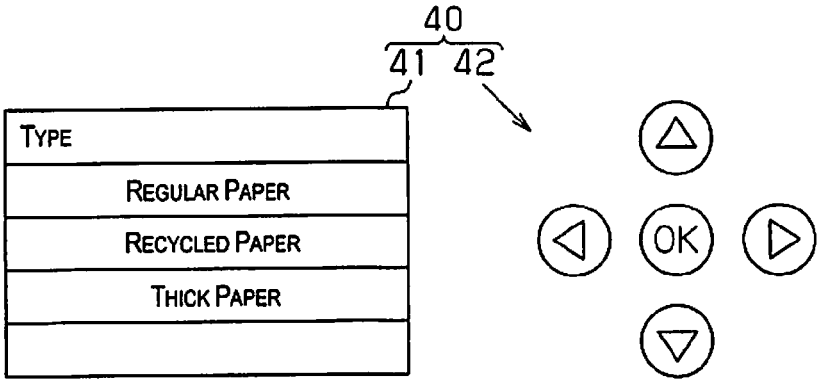

Also, when "Type" is selected with the display screen 41 shown in FIG. 4A, the display mode of the display screen 41 transitions from the display mode shown in FIG. 4A to the display mode shown in FIG. 4C. Specifically, the display mode shown in FIG. 4C is the mode for specifying the type of paper P housed in the paper feed cassette 20. Then, in this state, by operating the button operating unit 42 of the display operating panel 40, it is possible to specify the type of paper P housed in the paper feed cassette 20. This kind of transition from the display mode shown in FIG. 4A to the display mode shown in FIG. 4C is allowed whether the operating dial 31 is in the first mode or the second mode.

Figure 5:
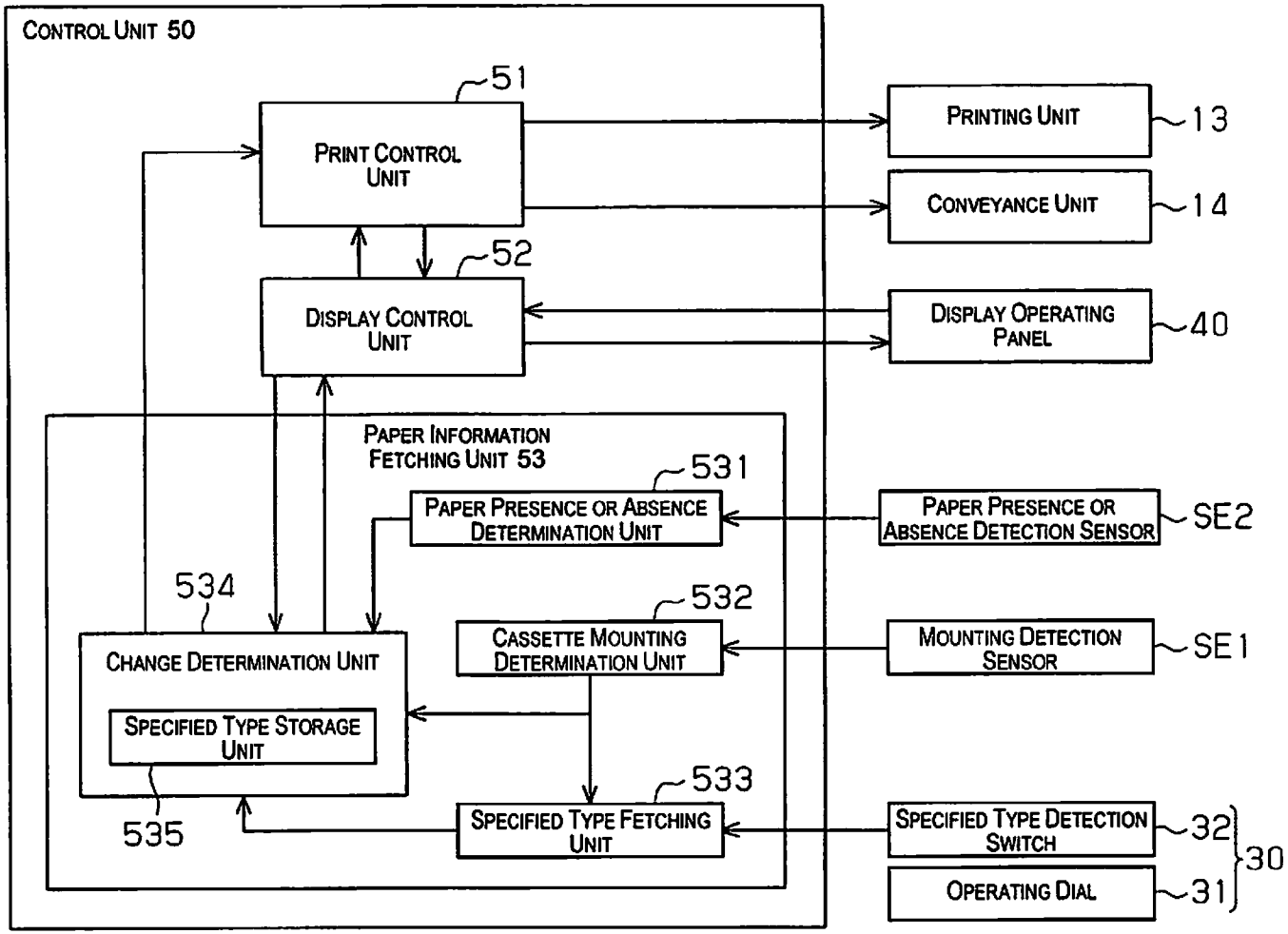
FIG. 5 is a block diagram showing the functional constitution of the control device of the printing device.

Next, referring to FIG. 5, we will describe a control device 50 of the printing device 11.

As shown in FIG. 5, as functional units constituted by at least one of hardware and software, the control device 50 has a print control unit 51, a display control unit 52, and a paper information fetching unit 53.

The print control unit 51 controls the printing unit 13 and the conveyance unit 14, and is in charge of printing control on the paper P.

Figure 7:
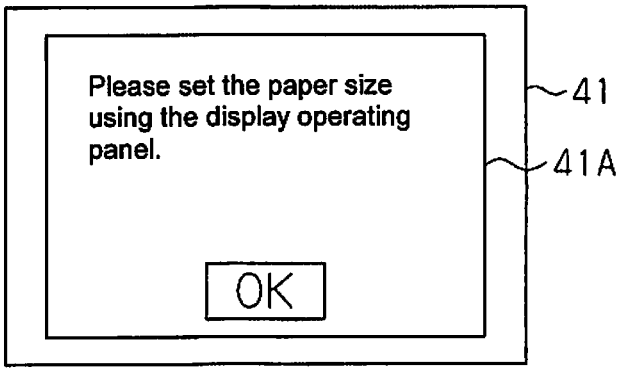
FIG. 7 is a drawing showing the display state of the display screen when the report process is implemented.

The display control unit 52 is in charge of display control of the display screen 41. Specifically, when a signal to the effect that the operating dial 31 is in the second mode is input from the paper information fetching unit 53, and it is detected that there has been a shift from the paper feed cassette 20 withdrawn state to the mounted state, the display control unit 52 implements a report process that displays on the display screen 41 a message to the effect of prompting operation of the display operating panel 40 to specify the size of the paper P inside the paper feed cassette 20. At this time, as shown in FIG. 7, the display control unit 52 implements display control so as to have the window 41A including that message overlap on the screen displayed on the display screen 41 before implementation of the report process.

Figure 8:
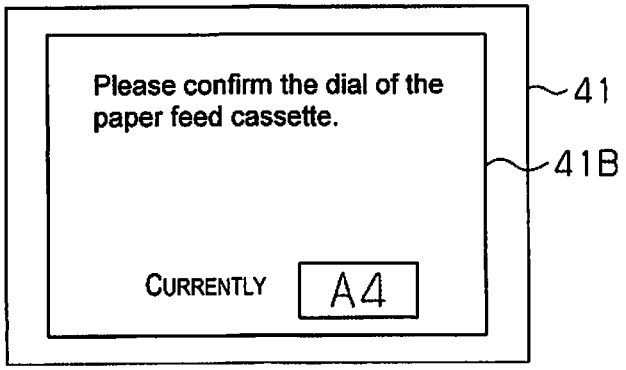
FIG. 8 is a drawing showing the display state of the display screen when the warning process is implemented.

Also, returning to FIG. 5, when a signal to the effect that the operating dial 31 is in the first state is input from the paper information fetching unit 53, the display control unit 52 allows implementation of the warning process that displays a message to the effect to prompt operation of the operating dial 31 on the display screen 41. Specifically, the display control unit 52 implements the warning process when the paper size specified by the operating dial 31 when it is detected by the mounting detection sensor SE1 that the paper feed cassette 20 is in a withdrawn state is the same as the paper size specified by the operating dial 31 when it is detected by the mounting detection sensor SE1 that the paper feed cassette 20 is in a mounted state. On the other hand, the display control unit 52 does not implement the warning process when the paper size specified by the operating dial 31 when it is detected by the mounting detection sensor SE1 that the paper feed cassette 20 is in a withdrawn state is different from the paper size specified by the operating dial 31 when it is detected by the mounting detection sensor SE1 that the paper feed cassette 20 is in a mounted state. As shown in FIG. 8, when the warning process is implemented, the display control unit 52 implements display control so as to have the window 41B including that message overlapped on the screen displayed on the display screen 41 before implementation of the warning process.

Also, returning to FIG. 5, signals are input to the display control unit 52 according to operation of the button operating unit 42 of the display operating panel 40 by the user. For example, information relating to the specified size and type is input to the display control unit 52 when the size and type of the paper P inside the paper feed cassette 20 is specified by operation of the button operating unit 42. Then, in this case, the display control unit 52 outputs information relating to the size and type of the paper P specified by the button operating unit 42 to the paper information fetching unit 53.

The paper information fetching unit 53 has a paper presence or absence determining unit 531, a cassette mounting determination unit 532, a specified type fetching unit 533, and a change determination unit 534.

The paper presence or absence determining unit 531 determines whether or not there is paper P inside the paper feed cassette 20 based on the signal input from the paper presence or absence sensor SE2. Then, the paper presence or absence determining unit 531 outputs information relating to the determination results to the change determination unit 534.

The cassette mounting determination unit 532 determines whether the paper feed cassette 20 is in the withdrawn state or the mounted state based on signals input from the mounting detection sensor SE1. Then, the cassette mounting determination unit 532 outputs information relating to the determination results to the specified type fetching unit 533 and the change determination unit 534.

When it has determined that the paper feed cassette 20 has shifted from the withdrawn state to the mounted state based on information input from the cassette mounting determination unit 532, the specified type fetching unit 533 fetches the mode of the operating dial 31 (first mode or second mode) based on signals output from the specified type detection switch 32. Then, the specified type fetching unit 533 outputs information relating to the mode of the operating dial 31 to the change determination unit 534. When the operating dial 31 is in the first mode, the specified type fetching unit 533 fetches the paper size specified by the operating dial 31, and outputs information relating to the fetched paper size to the change determination unit 534.

The change determination unit 534 includes a specified type storage unit 535. Stored in this specified type storage unit 535 is the paper size specified by the operating dial 31 at the point when the paper feed cassette 20 goes to the withdrawn state.

This kind of change determination unit 534 determines whether or not the operating dial 31 is in the second mode when the paper feed cassette 20 went to the mounted state. Then, when the operating dial 31 is in the second mode, the change determination unit 534 outputs a message to that effect to the display control unit 52.

On the other hand, when the operating dial 31 is in the first mode, the change determination unit 534 determines whether or not the paper size specified by the operating dial 31 at the point that the paper feed cassette 20 went to the mounted state is the same as the paper size stored in the specified type storage unit 535. Then, when the paper size specified by the operation dial 31 at the current point in time is different from the paper size stored in the specified type storage unit 535, the change determination unit 534 outputs a message to the display control unit 52 to the effect that implementation of the warning process noted above is prohibited. On the other hand, when the paper size specified by the operating dial 31 at the current point in time is the same as the paper size stored in the specified type storage unit 535, the change determination unit 534 outputs a message to the display control unit 52 to the effect that there is a request to execute the warning process noted above. However, in a state when there is no paper P inside the paper feed cassette 20 and that paper feed cassette 20 goes to the withdrawn state, after that, when the paper feed cassette 20 goes to the mounted state and there is paper P inside the paper feed cassette 20, the change determination unit 534 outputs a message to the display control unit 52 to the effect that implementation of the warning process is prohibited.

Figure 6:
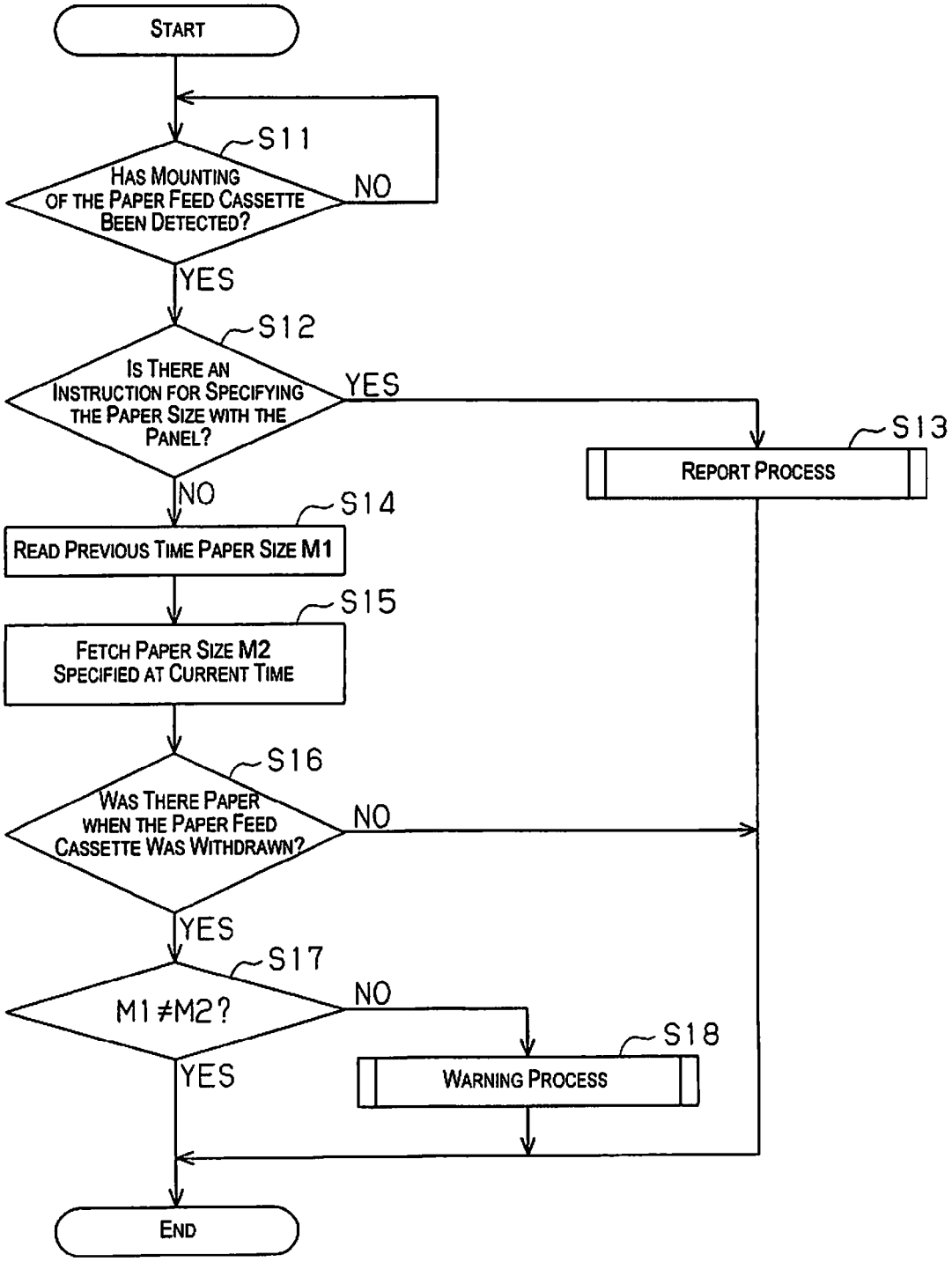
FIG. 6 is a flow chart showing the processing sequence when the paper feed cassette is mounted in the device main unit.

Next, while referring to the flow chart shown in FIG. 6, we will describe the processing sequence executed by the control device 50 when the paper feed cassette 20 shifts from the withdrawn state to the mounted state.

As shown in FIG. 6, the control device 50 determines whether or not the paper feed cassette 20 is mounted in the device main unit 12 based on the detection signals from the mounting detection sensor SE1 (step S11). Specifically, at this step S11, it is determined whether or not the paper feed cassette 20 has shifted from the withdrawn state to the mounted state. Then, when the paper feed cassette 20 has not yet been mounted in the device main unit 12 (step S11: No), the control device 50 repeatedly executes the determination process of step 11 until mounting of the paper feed cassette 20 to the device main unit 12 is detected.

Meanwhile, when the paper feed cassette 20 is mounted in the device main unit 12 (step S11: Yes), the control device 50 determines whether or not the specification of the paper size has been instructed using the display operating panel 40 based on the signal output from the specified type detection switch 32 (step S12). Specifically, a determination is made of whether or not the notation that can be seen from the communication window 23 of the paper feed cassette 20 is "Panel." Then, when the specification of the paper size is instructed with the display operating panel 40 (step S12: Yes), the control device 50 implements the report process (step S13), and ends the main processing.

On the other hand, when the specification of the paper size has not been instructed with the display operating panel 40 (step S12: No), the control device 50 reads from the specified type storage unit 535 the paper size M1 of the previous time which is the paper size specified by the operating dial 31 when the paper feed cassette 20 shifted from the mounted state to the withdrawn stage (step S14). Then, the control device 50 fetches the paper size M2 this time which is the paper size specified by the operating dial 31 at the current time based on the signal output from the specified type detection switch 32 (step S15).

Subsequently, the control device 50 determines whether or not there was paper P inside that paper feed cassette 20 immediately prior to the paper feed cassette 20 shifting from the mounted state to the withdrawn state (step S16). When there is no paper P inside that paper feed cassette 20 immediately prior to the paper feed cassette 20 shifting from the mounted state to the withdrawn state, during the current withdrawal of the paper feed cassette 20 from the device main unit 12, it is possible that paper of the same size as the paper loaded the previous time in the paper feed cassette 20 is loaded in the paper feed cassette 20. In this case, since it is possible that the user did not intentionally operate the operating dial 31, it is preferable that the warning process is not implemented. On the other hand, when there was paper P inside that paper feed cassette 20 immediately prior to the paper feed cassette 20 shifting from the mounted state to the withdrawn state, during withdrawal of the paper feed cassette 20 from the device main unit 12 this time, it is possible that paper of a different size from the paper loaded the previous time in the paper feed cassette 20 is loaded in the paper feed cassette 20. In this case, it is possible that the user did not intentionally operate the operating dial 31, so it is preferable to not implement the warning process. On the other hand, when there is paper P inside that paper feed cassette 20 immediately prior to the paper feed cassette 20 shifting from the mounted state to the withdrawn state, during withdrawal of the paper feed cassette 20 from the device main unit 12 this time, it is possible that paper of a size different from the paper loaded the previous time inside the paper feed cassette 20 will be loaded in the paper feed cassette 20. In this case, when the paper size specified by the operating dial 31 has not changed, it is possible that the user forgot to operate the operating dial 31, so it is preferable to implement the warning process.

Because of that, when there was no paper P inside that paper feed cassette 20 immediately prior to the paper feed cassette 20 shifting from the mounted state to the withdrawn state (step S16: No), the control device 50 ends this process without implementing the warning process. On the other hand, when there is paper P inside that paper feed cassette 20 when the paper feed cassette 20 shifts from the mounted state to the withdrawn state (step S16: Yes), the control device 50 determines whether or not the paper size M1 of the previous time read at step S14 is different from the paper size M2 this time fetched at step S15 (step S17). When the previous time paper size M1 is different from this time paper size M2 (step S17: Yes), the control device ends this process without implementing the warning process. On the other hand, when the previous time paper size M1 and this time paper size M2 are the same (step S17: No), the control device 50 implements the warning process (step S18) and then ends this process.

Next, while referring to FIG. 7 and FIG. 8, we will describe the operation of the printing device 11 of this embodiment.

We'll assume that the paper feed cassette 20 is withdrawn from the device main unit 12, and "B5" paper P is loaded into that paper feed cassette 20. In this case, a notation for indicating "B5" is not noted on the operating dial 31 provided on the paper feed cassette 20. Because of that, the operating dial 31 is operated by the user so as to be able to see the notation "Panel" from the communication window 23 of the paper feed cassette 20. Then, in this state, the paper feed cassette 20 is mounted in the device main unit 12. Having done that, a signal according to the mode of this operating dial 31 (specifically, the second mode) is output from the specified type detection switch 32 to the control device 50.

As a result, as shown in FIG. 7, displayed on the display screen 41 of the display operating panel 40 is a window 41A including the message, "Please set the paper size using the display operating panel" (report process). Having done that, the user who sees that window 41A operates the display operating panel 40 and specifies the size of the paper P inside the paper feed cassette 20.

Also, for example the paper feed cassette 20 which still has "A4" paper P in it is withdrawn from the device main unit 12, and the paper in the paper feed cassette 20 is changed from "A4" to "A5." At this time, when the user forgets to operate the operating dial 31 and the paper feed cassette 20 is mounted in the device main unit 12, the notation that is visible from the communication window 23 of the paper feed cassette 20 is left as "A4." In this case, since the previous time paper size M1 is the same as the current time paper size M2, as shown in FIG. 8, on the display screen 41 of the display operating panel 40 is displayed a window 41B including the message, "Please confirm the paper feed cassette dial" (warning process).

The user who sees this kind of window 41B operates the operating dial 31 after putting the paper feed cassette 20 in the withdrawn state. Then, the user confirms that the notation that is visible from the communication window 23 is "A5" and mounts the paper feed cassette 20 into the device main unit 12.

When operation of the operating dial 31 is not detected even after the elapsed time from the start of the window 41B shown in FIG. 8 being displayed has elapsed past a designated time (e.g. about 10 seconds), it is possible that the size of the paper currently housed in the paper feed cassette 20 is the same as the paper size specified by the operating dial 31. Specifically, when the paper feed cassette 20 is mounted in the device main unit 12, it is possible that the user did not intentionally operate the operating dial 31. Because of that, when operation of the operating dial 31 is not detected even when the aforementioned elapsed time has elapsed for a designated time, the window 41B shown in FIG. 8 is made to disappear naturally from the display screen 41.

On the other hand, there are cases when in a state with no paper P, the paper feed cassette 20 is withdrawn from the device main unit 12, and that paper feed cassette 20 is mounted in the device main unit 12 in a state with paper P loaded. In this case, it is possible that the size of the paper P loaded inside the paper feed cassette 20 before it goes to a withdrawn state is the same as the size of the paper P loaded this time in the paper feed cassette 20. Because of that, in this case, even if the paper size specified by the operating dial 31 does not change for before withdrawal of the paper feed cassette 20 from the device main unit 12 and after mounting of the paper feed cassette 20 to the device main unit 12, the window 41B shown in FIG. 8 is not displayed on the display screen 41.

With the embodiment as described above, it is possible to obtain the following kinds of effects.

(1) When the paper size specified by the operating dial 31 when the paper feed cassette 20 is withdrawn from the device main unit 12 is the same as the paper size specified by the operating dial 31 when the paper feed cassette 20 is mounted in the device main unit 12 after that, when loading paper P in that paper feed cassette 20, it is possible that the user forgot to operate the operating dial 31. Because of that, in this case, by implementing the warning process, it is possible to prompt the user to operate the operating dial 31. Therefore, it is possible to inhibit forgetting of specifying the size of the paper housed in the paper feed cassette.

(2) Also, when the paper size specified by the operating dial 31 when the paper feed cassette is withdrawn from the device main unit 12 is different from the paper size specified by the operating dial 31 when the paper feed cassette 20 is mounted in the device main unit 12 after that, it is possible to judge that the user operated the operating dial 31. Because of that, in this case, the warning process is not implemented. Specifically, it is possible to reduce the opportunities for inadvertent implementation of the warning process to occur despite suitable operation of the operating dial 31 by the user.

(3) By having the operating dial 31 be in the second mode, it is possible to prompt specification of the paper size by operation of the display operating panel 40. Specifically, when the operating dial 31 is in the second mode, when the paper feed cassette 20 is mounted in the device main unit 12, rather than the warning process, the report process is implemented that prompts specification of the paper size by operation of the display operating panel 40. Therefore, even if the operating dial 31 is in the second mode, it is possible to suitably give guidance to the user on specification of the size of the paper P in the paper feed cassette 20.

(4) There are cases when in a state when there is still paper P inside the paper feed cassette 20, that same paper feed cassette 20 is withdrawn from the device main unit 12, and after that, the paper feed cassette 20 is mounted in the device main unit 12. In this case, there is a possibility that the size of the paper P housed inside the paper feed cassette 20 has changed, so when the paper feed cassette 20 is mounted in the device main unit 12, the warning process is implemented. Therefore, it is possible to suitably prompt the user to specify the paper size.

(5) On the other hand, there are cases when in a state with no paper P inside the paper feed cassette 20, that same paper feed cassette is withdrawn from the device main unit 12, and after that, the paper feed cassette 20 is mounted in the device main unit 12. In this case, it is possible that paper of the same size as the paper P loaded the previous time is loaded in the paper feed cassette 20, so the warning process is not implemented. Because of that, when specification of the paper size is unnecessary, it is possible to suppress inadvertent implementation of the warning process.

The embodiments noted above can also be modified as shown below.

It is also possible to provide a specification operating unit for specifying the type of paper (recycled paper, thick paper and the like) housed in the paper feed cassette 20. In this case, it is also possible to provide a detection switch that outputs to the control device 50 signals according to the type of paper specified by that specification operating unit when the paper feed cassette 20 is in a mounted state in the device main unit 12. Then, when the paper type specified by the specification operating unit when the paper feed cassette 20 went to a withdrawn state is the same as the paper type specified by the specification operating unit when the paper feed cassette 20 is in the mounted state after that, the warning process can be implemented, and when they are different, the warning process can be not implemented.

It is also possible to have the warning process implemented when the previous time paper size M1 and this time paper size M2 are the same even when in a state when there is no paper P in the paper feed cassette 20, that same paper feed cassette 20 is withdrawn from the device main unit 12, and after that, the paper feed cassette 20 is mounted in the device main unit 12.

It is also possible to not provide the paper presence or absence sensor SE2 on the device main unit 12. In this case, the flow chart shown in FIG. 6 preferably omits the determination process of step S16.

It is also possible to not provide the mounting detection sensor SE1 on the device main unit 12. In this case, it is possible to detect shifting of the paper feed cassette 20 from the withdrawn state to the mounted state based on changes in the output mode of signals from the paper presence or absence sensor SE2.

Figure 9:
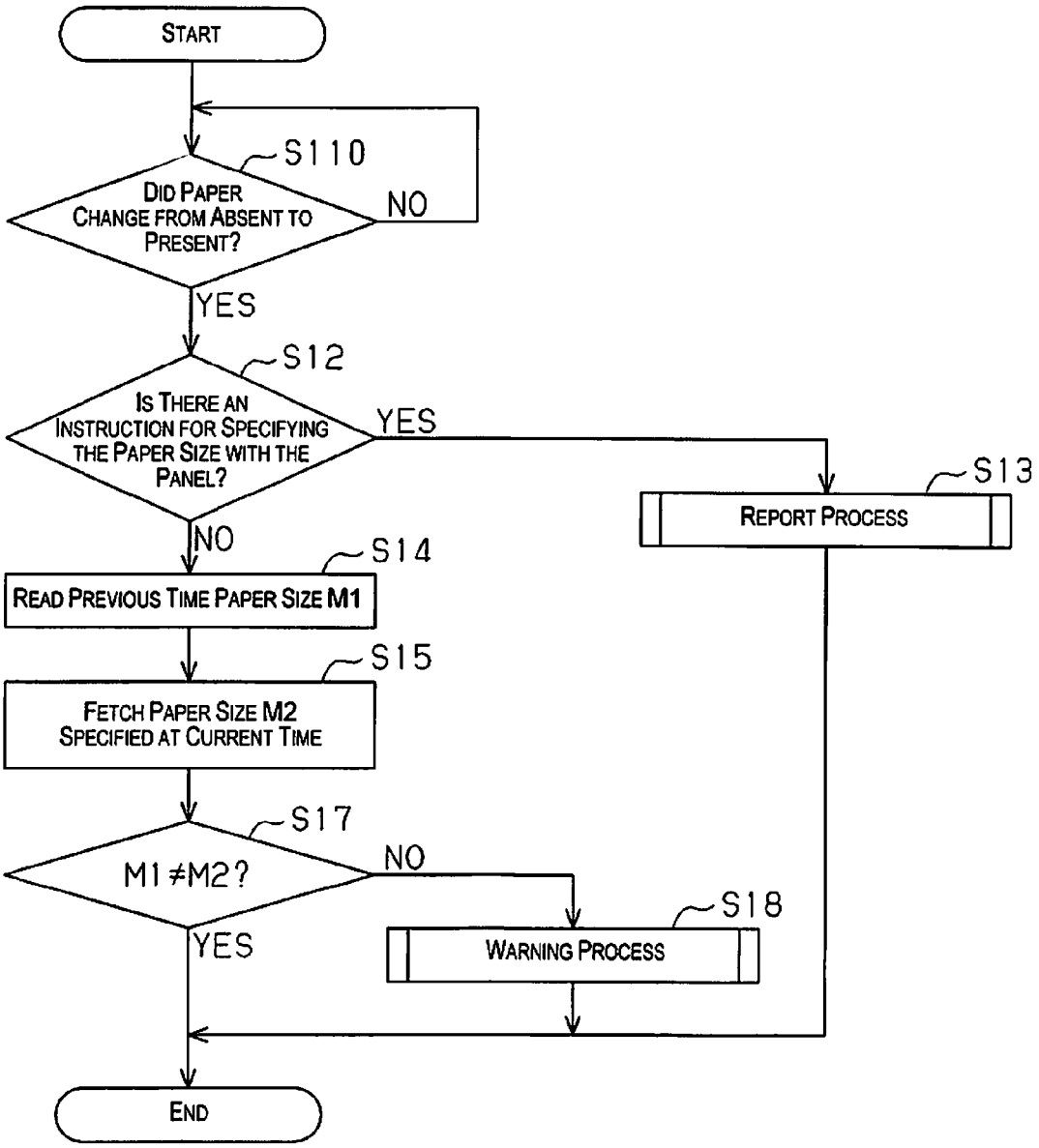
FIG. 9 is a flow chart showing the processing sequence when the paper feed cassette is mounted in the device main unit with the printing device of another embodiment.

In this case, as shown in FIG. 9, the control device 50 determines whether or not there has been a change from a state with no paper P to a state with it in the paper feed cassette 20 (step S10). Specifically, to load paper P in the paper feed cassette 20, it is necessary to have the paper feed cassette 20 be in the withdrawn state. Because of that, when there has been a change from a state with no paper P to a state with it in the paper feed cassette 20, it is possible to judge that the paper feed cassette 20 has been mounted in the device main unit 12. A description will be omitted here from the processing of this step S12 and thereafter.

When it is not possible to load into the paper feed cassette 20 the paper P of a size other than the paper size noted on the one surface 312 of the operating dial 31, it is also possible to not provide the notation "Panel" on the operating dial 31.

As long as the warning process is able to prompt the user to operate the operating dial 31, it is possible to prompt the user to operate the operating dial 31 using any method other than displaying a message on the display screen 41. For example, the warning process can also be a process that includes the process of prompting the user to operate the operating dial 31 using voice.

The report process can be a process that displays on the display operating panel 40 for example the screen shown on FIG. 4B or FIG. 4C. In this case, it is also possible to have the paper size or paper type specified by having the user operate the display operating panel 40.

As long as the report process is able to prompt the user to operate the display operating panel 40, it is possible to prompt the user to operate the display operating panel 40 using any method other than displaying a message on the display screen 41. For example, the report process can also be a process that includes the process of prompting the user to operate the display operating panel 40 using voice.

The specification operating unit provided on the paper feed cassette 20 can have any constitution other than the operating dial 31 as long as it is possible to specify the paper size.

The printing device 11 can also be a constitution equipped with a plurality of paper feed cassettes 20. In this case, it is preferable that the type detection system 30 be provided for every paper feed cassette 20.

As long as the media is media that can be printed using the printing unit 13, it can be a media other than paper such as film, fabric or the like.

Next we will add a description hereafter of the technical concepts that can be understood from the embodiment noted above and other embodiments.

(A) When the type of media specified by the specification operating unit when the housing unit is withdrawn from the device main unit is the same as the type of media specified by the specification operating unit when that same housing unit is mounted in that same device main unit after the housing unit is withdrawn from the device main unit, it is preferable that the control device implement the warning process when that housing unit is mounted in the device main unit.

(B) When the specification operating unit is in the second mode, when the housing unit is mounted in the device main unit, it is preferable that the control unit implement the report process.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

a device main unit, inside of which printing is implemented on a medium;

a housing unit in which the medium is housed, the housing unit being configured to be withdrawn from the device main unit and mounted in the device main unit;

a first specification operating unit provided on the housing unit, the first specification operating unit being configured to be operated by a user in order to specify a type of the medium housed in the housing unit;

a memory unit storing a specified type of the medium, which is specified at the first specification operating unit;

an output unit configured to output to the user a warning that prompts the user to operate the first specification operating unit; and a control device configured to implement control according to the type of the medium specified by the first specification operating unit and control the output unit, the control device being configured to perform a process in response to the housing unit being mounted in the device main unit after being withdrawn from the device main unit, and to perform the process, the control device being configured to read out a previous type of the medium from the memory unit, which has been specified previously by the first specification operating unit, obtain a current type of the medium specified by the first specification operating unit in response to the housing unit being mounted into the device main unit after being withdrawn from the device main unit, determine whether or not the previous type of the medium and the current type of the medium are equal to each other, and in response to determining that the previous type of the medium and the current type of the medium are equal to each other, implement a warning process by controlling the output unit to output the warning to the user.

2. The printing device according to claim 1, wherein the control device is further configured to end the performing of the process without implementation of the warning process in response to determining that the previous type of the medium and the current type of the medium are not equal to each other.

3. The printing device according to claim 1, wherein the device main unit includes a second specification operating unit operated in order to specify the type of the medium housed inside the housing unit, the second specification operating unit being separate from the first specification operating unit, the first specification operating unit is constituted so as to select a first mode for specifying the control device for control according to the type of the medium specified by the first specification operating unit, and a second mode for specifying the control device for control in charge of an operation of the second specification operating unit for specifying the type of the medium inside the housing unit, the control device is further configured to allow implementation of the warning process when the first specification operating unit is in the first mode, and the control device is further configured to implement a report process that prompts specification of the type of the medium with the second specification operating unit without implementing the warning process when the first specification operating unit is in the second mode.

4. The printing device according to claim 1, further comprising a mounting detection sensor configured to detect withdrawal of the housing unit from the device main unit and mounting of the housing unit into the device main unit, wherein the control device is configured to, in response to the mounting detection sensor detecting the mounting of the housing unit into the device main unit after detecting the withdrawal of the housing unit from the device main unit, to preform the process, read out the previous type of the medium from the memory unit, which has been previously specified when the mounting detection sensor detects the withdrawal of the housing unit from the device main unit, and obtain the current type of the medium specified by the first specification operating unit in response to the mounting detection sensor detecting the mounting of the housing unit mounted into the device main unit after detecting the withdrawal of the housing unit from the device main unit to determine whether or not the previous type of the medium and the current type of the medium are equal to each other.

5. The printing device according to claim 4, further comprising a media presence or absence sensor configured to detect a presence or absence of the medium inside the housing unit, wherein in a state for which the media presence or absence sensor detects the presence of the medium inside the housing unit, when the mounting detection sensor detects the withdrawal of the housing unit from the device main unit, the control device is configured to allow implementation of the warning process when the media presence or absence sensor detects the presence of the medium inside the housing unit when, after the mounting detection sensor has detected the withdrawal of the housing unit from the device main unit, the mounting detection sensor detects the mounting of the housing unit into the device main unit.

6. The printing device according to claim 5, wherein in a state for which the media presence or absence sensor detects the absence of the medium inside the housing unit, when the mounting detection sensor detects the withdrawal of the housing unit from the device main unit, the control device is configured to prohibit implementation of the warning process, when the media presence or absence sensor detects the presence of the medium inside the housing unit when, after the mounting detection sensor has detected the withdrawal of the housing unit from the device main unit, the mounting detection sensor detects the mounting of the housing unit into the device main unit.

7. The printing device according to claim 1, further comprising a media presence or absence sensor configured to detect a presence or absence of the medium inside the housing unit, wherein when the media presence or absence sensor detects a shift from a state of the absence of the medium inside the housing unit to a state of the presence of the medium inside the housing unit, the control device is further configured to determine the mounting of the housing unit into the device main unit.

8. The printing device according to claim 1, wherein the type of the medium specified by the first specification operating unit includes a medium size.

9. The printing device according to claim 1, wherein when the previous type of the medium and the current type of the medium are equal to each other, the output unit outputs to the user the warning that prompts the user to operate the first specification operating unit, and when the previous type of the medium and the current type of the medium are not equal to each other, the output unit does not output to the user the warning that prompts the user to operate the first specification operating unit.

* * * * *